US007114527B2

(12) United States Patent
Von Zwehl et al.

(10) Patent No.: US 7,114,527 B2
(45) Date of Patent: Oct. 3, 2006

(54) METHOD FOR OPERATING A DRIVE ASSEMBLY OF A LOOM AND SHEDDING MACHINE COMPRISING DIVIDED DRIVE TECHNOLOGY

(75) Inventors: Dietmar Von Zwehl, Achberg (DE); Michael Lehmann, Lindau (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 151 days.

(21) Appl. No.: 10/505,309

(22) PCT Filed: Jan. 31, 2003

(86) PCT No.: PCT/DE03/00264

§ 371 (c)(1),
(2), (4) Date: Aug. 20, 2004

(87) PCT Pub. No.: WO03/071017

PCT Pub. Date: Aug. 28, 2003

(65) Prior Publication Data

US 2005/0178457 A1 Aug. 18, 2005

(30) Foreign Application Priority Data

Feb. 20, 2002 (DE) ..... 102 06 972

(51) Int. Cl.
*D03D 51/02* (2006.01)

(52) U.S. Cl. ..... 139/1 E; 139/1 R

(58) Field of Classification Search ..... 139/1 E, 139/1 R; 700/140

See application file for complete search history.

(56) References Cited

U.S. PATENT DOCUMENTS

| | | | | |
|---|---|---|---|---|
| 5,642,757 | A * | 7/1997 | Froment et al. | 139/1 E |
| 6,307,340 | B1 * | 10/2001 | Wagner et al. | 318/431 |
| 6,532,996 | B1 * | 3/2003 | Tamura | 139/1 E |
| 6,962,171 | B1 * | 11/2005 | Krumm et al. | 139/116.2 |
| 2004/0031533 | A1 | 2/2004 | Krumm et al. | |

FOREIGN PATENT DOCUMENTS

| | | |
|---|---|---|
| DE | 20021049 | 5/2001 |
| DE | 10053079 | 5/2002 |
| DE | 10161789 | 7/2003 |
| EP | 0010267 | 4/1980 |

* cited by examiner

*Primary Examiner*—John Calvert
*Assistant Examiner*—Andrew W. Sutton
(74) *Attorney, Agent, or Firm*—W. F. Fasse; W. G. Fasse

(57) ABSTRACT

A method achieves highly constant energy in the operation of a loom and shedding machine with separated drive technology, and ensures the run-up in one weft insertion for the loom and if necessary also for the shedding machine. The control arrangement controlling the electric motor drive of the loom and shedding machine includes a computer arrangement which, depending on machine and/or weaving technical data, determines the applicable size of the moment of inertia of a non-inherent inertial mass with which at least the shedding machine is to be equipped, and the at least one non-inherent inertial mass is arranged in such a manner, so that the determined size of the moment of inertia becomes effective in the operation of the shedding machine.

5 Claims, 1 Drawing Sheet

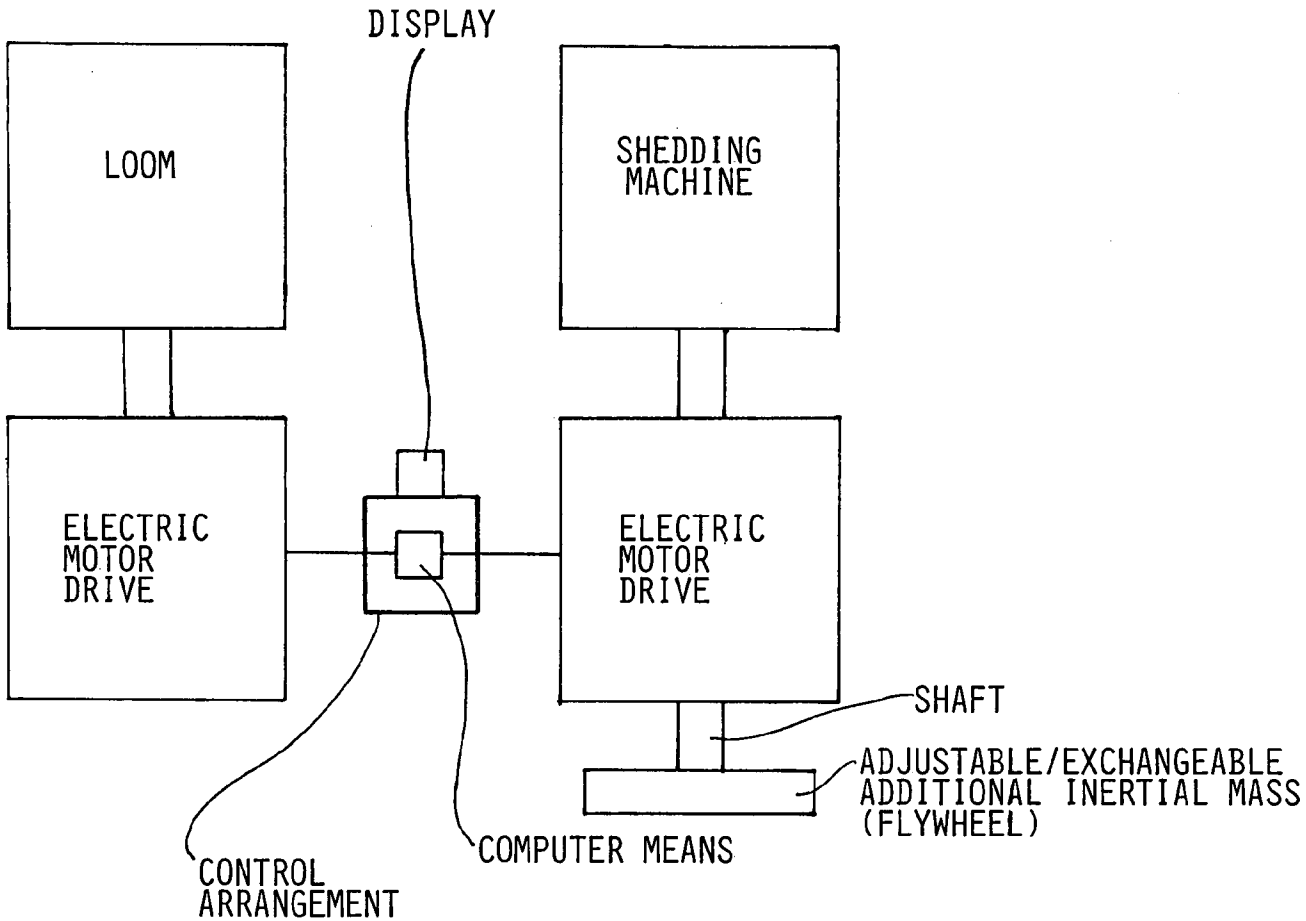
SHEDDING MACHINE
ELECTRIC MOTOR DRIVE
SHAFT
ADJUSTABLE/EXCHANGEABLE ADDITIONAL INERTIAL MASS (FLYWHEEL)
DISPLAY
COMPUTER MEANS
CONTROL ARRANGEMENT
LOOM
ELECTRIC MOTOR DRIVE

METHOD FOR OPERATING A DRIVE ASSEMBLY OF A LOOM AND SHEDDING MACHINE COMPRISING DIVIDED DRIVE TECHNOLOGY

FIELD OF THE INVENTION

Known weaving machines or looms with a so-called electric motor direct drive, i.e. a drive that is not separatable from the main drive shaft of the loom during the running operation, have an operating behavior that is recognizable clearly from the sharply varying loom rotational speed per weaving cycle, among other things.

BACKGROUND INFORMATION

For the compensation of rotational speed fluctuations of the loom, a drive arrangement for a loom and a shedding machine is known from DE-U 200 21 049.1, wherein at least the main drive shaft of the loom has an additional rotating inertial mass or flywheel mass for the compensation of the rotational speed fluctuations. This additional inertial mass, however, has a negative effect on the acceleration process during the start-up of the loom. This is problematic for applications with high operating rotational speed, especially if the run-up for the loom is required "in one weft insertion" for ensuring the woven fabric quality, that is to say the dynamics already of the first reed beat-up must correspond to the dynamics of the following reed beat-ups. If an additional inertial mass must also be accelerated, this quickly increases the drive power that is to be installed, to a level that is no longer economically justifiable.

In other looms with electric motor direct drive, an inertial mass connected with the main drive shaft is omitted or avoided, in order not to delay or to make-difficult the acceleration process during the start-up of the loom. The avoidance or omission of an additional inertial mass, however, as already discussed above, leads to considerable rotational speed fluctuations per weaving cycle. For the compensation of the rotational speed fluctuations, it is obvious to influence the fluctuations in the rotational speed of the electric motor drive through corresponding controlling or regulating of the supply of electrical energy. Such influencing, however, leads to considerable loading of the drive train of the loom and of the shedding machine. Moreover, such a rotational speed compensation does not lead to an operating manner with energy constancy; the resistive or dissipative heat losses and loading for the motor and power electronics are very high.

It is further known from DE-U 200 21 049.1 to separate the loom and the shedding machine with respect to the drive technology, that is to say to allocate at least respectively one electric motor drive to the main drive shaft of the loom and to the drive shaft of the shedding machine. Associated therewith is the advantage that a rigid synchronization between loom and shedding machine is no longer present; at any time it is thus fundamentally possible to flexibly embody the tuning or adaptation of the operating behavior of loom and shedding machine corresponding to the weaving requirements, that is to say to select the synchronicity of both drive systems with respect to basic tuning or adaptation (for example shed closure at what loom position angle) and with respect to the permissible tolerances within broad limits. This embodiment of the drive synchronicity as desired within broad limits, however, in turn leads to considerable loading of the drive train of the loom and/or shedding machine; and similarly, due to the necessary control or regulating efforts, the resistive or dissipative heat losses and loading of the motor and the power electronics become very high. These disadvantages become still greater because the loading of the electric motor drive of the shedding machine is dependent on the motions of the shedding means (shafts; lifters), thus dependent on the weave pattern or generally dependent on the weaving application.

Now, due to the omission of the previous rigid coupling between loom and shedding machine, however, influences for the tuning or adaptation of the operating behavior of both machines become necessary in such a manner so that the so-called weft insertion window, with reference to the respective operating rotational speed, becomes as large as possible and/or reproduces itself as exactly as possible weft for weft in its time duration and/or development (that is to say how it opens or closes). This requirement arises very essentially in connection with gripper looms, wherein a gripper running character that is poorly tuned or adapted to the weft insertion window leads, for example, to the occurrence that the grippers do enter into the shed at the correct time point, but leave it too late. Thus, the gripper heads and/or the gripper rods rub on the warp threads of the shed that is already closing again. This can unduly heat the heads or rods, but also the warp threads. Moreover, this forced opening of the shed by the above mentioned gripper elements can produce defect locations in the woven fabric.

SUMMARY OF THE INVENTION

It is an object of the invention, in looms and shedding machines with separate drive technology, under the boundary conditions of an at least point-wise synchronous operation,

- to achieve a high energy constancy in the operation of the loom as well as the shedding machine, that is to say to minimize or at least to considerably reduce the current consumption, the resistive or dissipative heat losses as well as the loading of the power electronics and motor,
- to make possible the adjustment or setting of—nearly—the best possible weaving technical conditions or relationships with respect to the position of the shed closure, duration of the weft insertion window, relative to the duration of the weaving cycle, progression development of the weft insertion window, under consideration of machine and weaving technical data, and to achieve this including the case of sharply varying or differing motion of the shedding means within the weave pattern repeat,
- to ensure the preservation or gentle treatment of the mechanics of loom and shedding machine, and
- to ensure the run-up within one weft insertion for the loom and if necessary also for the shedding machine.

Point-wise synchronous operation is to be understood to mean that the drive of the loom and the shedding machine is operated synchronously in a predefinable point, weaving cycle for weaving cycle. This point can be different weaving cycle for weaving cycle.

The object is achieved according to the invention in that a control arrangement for the control of the electric motor drive of the loom and for the control of the electric motor drive of the shedding machine comprising at least one additional inertial mass possesses or has suitable computer means, which determines the applicable size or magnitude of the moment of inertia of the inertial mass to be allocated dependent on machine and/or weaving technical data, and in that suitable means are present, which make it possible to arrange or set-up the at least one additional inertial mass in such a manner so that the magnitude of the determined moment of inertia becomes effective in the operating of the shedding machine.

BRIEF DESCRIPTION OF THE DRAWING

The accompanying single drawing figure schematically illustrates a block diagram of an arrangement for carrying out an example embodiment of the inventive method. The arrangement includes a loom and a shedding machine each respectively connected to a respective electric motor drive, an adjustable and/or exchangeable inertial mass (e.g. flywheel), and a control arrangement including computer means.

DETAILED DESCRIPTION OF EXAMPLE EMBODIMENTS OF THE INVENTION

Such additional, that is to say not inherent, inertial masses do reduce the dynamics of the shedding machine, yet the solution according to DE 100 53 079 of the applicant provides the possibility to start and to stop the shedding machine more slowly than the loom. Through this achieved degree of freedom, the installation of non-inherent inertial masses becomes possible without or without significant enlargement of the drive unit.

Thus, through a correspondingly large additional or auxiliary inertial mass on the drive shaft, the rotational speed fluctuations of the shedding machine can be kept very small, regardless how strong the motion of the shedding means is. The drive transmission of the shedding machine can be laid out under the prescription of a constant rotational speed of the drive shaft; moreover, the motion course or progression curves of the loom transmission (for reed and grippers) can be optimized for this behavior of the shedding machine, so that the object with respect to weft insertion is achieved. Thereby, a direct drive without additional inertial mass can be fundamentally provided for the loom.

A further improvement of the optimization criteria can be achieved in that an additional or auxiliary inertial mass is fixedly specified for a shedding machine with a certain maximum possible motion of the shedding means. Thus, as an example, in connection with an electronic dobby machine, one can define the band width of no shedding means motion up to and including heald frames or shafts 1 to 6 in a 1:1 binding weave as a "range of weak shedding means motion". One specifies the size of the additional inertial mass in such a manner so that a prescribed tolerance in the rotational speed oscillation is not exceeded in connection with the strongest shedding means motion (that is to say heald frames or shafts 1 to 6 in 1:1 binding weave). Now, the transmission of the shedding machine can either be laid out or designed according to the principle of the rotational speed constancy, or on the basis of a defined rotational speed oscillation on the drive shaft, which preferably corresponds to the average shedding means motion within the range "range of small shedding means motion". In the example, this average shedding means motion may correspond approximately to the motion of the heald frames or shafts 1 to 4 in 1:1 binding weave. The characteristic progression curves of the loom transmission (for reed and grippers) are correspondingly adapted or matched (see above).

If one now defines, for example, ranges of medium- or middle-strong and strong shedding means motion, thereby, through installation of corresponding larger inertial masses, one can again achieve the level and the progression of the rotational speed oscillation as for the range of weak shedding means motion. The transmission of the shedding machine once again experiences the operating conditions or relationships for which it has been laid out or designed, similarly the tuning or adaptation with the characteristic progression curves of the loom transmission is again produced in the best possible manner.

The advantages of the use of differently sized inertial masses in comparison to a fixedly or rigidly installed very large initial mass are:

- The applicability of the principle of the solution also on eccentric machines, since the often required run-up in one weft insertion is possible, because it is possible to manage or make-do with a very small additional inertial mass (in certain circumstances entirely without) in connection with weak shedding means motion, without having the rotational speed fluctuations exceed the prescribed requirements of the producer; the acceleration to high rotational speeds in one weft insertion is thus possible. In connection with stronger shedding means motion an additional inertial mass is necessary for the limitation of the rotational speed fluctuations, yet however, simultaneously the permissible operating rotational speeds are reduced, so that the direct drive even now manages or achieves the run-up in one weft insertion even with the additional inertial mass.
- In the shedding machines, so-called profiles are commonly used—shed opening/shed closure in sharper or more-moderate motion embodied according to the transmission. A sharp motion enlarges the weft insertion window, however does not allow so high operating rotational speeds as a moderate motion. Through the use of differently sized additional or auxiliary inertial masses, various different profiles can be produced, that is to say only the additional inertial masses must be exchanged or readjusted, but it is not necessary to intervene in the transmission.

In a simple embodiment of the invention, therefore, the at least one additional inertial mass of a first predetermined fixed size can be exchanged with a different additional inertial mass that is of a second predetermined fixed size.

For avoiding the assembly or installation time necessary for the exchange of the inertial mass, according to the invention an inertial flywheel with a variable or adjustable moment of inertia can be provided, as is the subject matter of the DE Patent Application 101 61 789.5 of the applicant, for example. In that regard, the flywheel consists of a base body that is rotationally fixedly connected with the drive shaft of the shedding machine and at least two partial masses that are radially movable relative to the rotation axis on the base body, whereby the radial position of the partial masses is changeable through operating means, for example during the rotation of the flywheel. In that regard, the operating means can be an integral component of the flywheel and comprise adjusting or actuator means that act directly or indirectly on the partial masses.

In a preferred embodiment of the invention, the moment of inertia of the hereby variable or adjustable additional inertial mass(es) can be changed or adapted between a minimum and a maximum continuously dependent on the operating behavior of the shedding machine.

Suitable computer means can, for example dependent on machine and weaving technical data, automatically determine the applicable size or magnitude of the moment of inertia of the additional inertial mass(es), and represent or indicate this to the operator of the loom, preferably in the display of the loom control. In this regard, especially the following should be mentioned as machine technical data:

Loom
Type (for example gripper or air jet loom)
Nominal width
Type of the grippers, gripper rods; gripper stroke (in gripper looms)
Transmission data
Shedding machine
Type (for example gripper or air jet loom)
Nominal width
Number and arrangement of the shedding means
Transmission data In this regard, especially the following should be mentioned as weaving technical data:

Shed angle
Shed closure angle
Desired profile (because this is no longer fixedly or rigidly coupled to the transmission data—see above), or instead of that, also as decision possibility for the operator.
Optimization to highest possible operating rotational speed or:
Optimization to longest or largest possible weft insertion window or:
Compromise of both
Number and type of the warp threads
Warp tension
Weaving pattern
Operating rotational speed(s)

The adjustment or adjusted setting of the additional inertial mass(es) and/or the exchange of the additional inertial mass(es) and/or the supplementing/reduction of the additional inertial mass(es) in that regard can be carried out manually or can be achieved automatically through suitable means.

The motion profiles of the loom and the shedding machine that are well tuned or adapted already on the side of the transmission due to the additional inertial mass(es) have as a result, that the required control/regulation demand for weaving technical synchronization of both machines is considerably reduced, whereby also the intended nearly energy-constant operation of both machines becomes possible—and therewith in turn current consumption, resistive or dissipative heat losses as well as the loading of the power electronics and motor are held to a low level.

The invention claimed is:

1. Method for operating a drive arrangement for a loom and a shedding machine with respectively at least one rotational-speed-variable electric motor drive, whereby the electric motor drive of the loom and the drive of the shedding machine is operated in the sense of an at least point-wise synchronization relative to each other in the running operation, that is to say weaving cycle for weaving cycle, whereby at least one additional inertial mass that is changeable in the moment of inertia and that also rotates along is allocated at least to the shedding machine, and whereby a control arrangement at least for the controlling of the electric motor drive is present, characterized in that the inertial mass comprises an inertial flywheel having inertial mass segments that are adjustable or shiftable with respect to radial positions thereof, wherein the inertial flywheel has an adjustable moment of inertia, and in that the control arrangement includes a computer arrangement which determines the applicable size of the moment of inertia of the inertial mass to be allocated dependent on machine and/or weaving technical data, and in that the at least one additional inertial mass is arranged in such a manner so that the determined size of the moment of inertia becomes effective in the operating of the shedding machine.

2. Method according to claim 1, characterized in that the determined size of the moment of inertia is indicated in a suitable form.

3. Method according to claim 1, characterized in that the arranging of the inertial mass occurs automatically.

4. Method according to claim 1, characterized in that the arranging of the inertial mass occurs manually through exchange of one inertial mass for a different inertial mass.

5. Method according to claim 1, characterized in that the inertial mass or the inertial mass segments are connected with a shaft of the shedding machine via suitable releasable connections.

* * * * *